US011598181B2

(12) United States Patent
Adam et al.

(10) Patent No.: US 11,598,181 B2
(45) Date of Patent: Mar. 7, 2023

(54) SYSTEM FOR SETTING A LOWER COMPLETION AND CLEANING A CASING ABOVE THE LOWER COMPLETION

(71) Applicants: Mark Kendall Adam, Houston, TX (US); Colin Patrick Andrew, Cypress, TX (US); Travis Treadway, Huffman, TX (US); Jonathan Nicholas Croy, Katy, TX (US); Michael Barron, Houma, LA (US); Brian Magnus, Spring, TX (US)

(72) Inventors: Mark Kendall Adam, Houston, TX (US); Colin Patrick Andrew, Cypress, TX (US); Travis Treadway, Huffman, TX (US); Jonathan Nicholas Croy, Katy, TX (US); Michael Barron, Houma, LA (US); Brian Magnus, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/147,802

(22) Filed: Jan. 13, 2021

(65) Prior Publication Data

US 2022/0220831 A1 Jul. 14, 2022

(51) Int. Cl.

| | |
|---|---|
| ***E21B 43/10*** | (2006.01) |
| ***E21B 37/04*** | (2006.01) |
| ***E21B 34/14*** | (2006.01) |

(52) U.S. Cl.

CPC ..... *E21B 43/10* (2013.01); *E21B 34/142* (2020.05); *E21B 37/04* (2013.01); *E21B 2200/04* (2020.05)

(58) Field of Classification Search

CPC ..... E21B 43/10; E21B 34/142; E21B 37/04; E21B 2200/04

See application file for complete search history.

(56) References Cited

U.S. PATENT DOCUMENTS

| | | | | |
|---|---|---|---|---|
| 2001/0040035 | A1 | 11/2001 | Appleton et al. | |
| 2012/0199346 | A1 | 8/2012 | Patel et al. | |
| 2014/0014347 | A1 * | 1/2014 | Adam | E21B 34/12 166/308.1 |
| 2016/0305219 | A1 | 10/2016 | Holloway et al. | |

(Continued)

OTHER PUBLICATIONS

International Search Report and Written Opinion for International Application No. PCT/US2022/011555; International Filing Date Jan. 7, 2022; Report dated Apr. 22, 2022 (pp. 1-6).

*Primary Examiner* — Taras P Bemko

(74) *Attorney, Agent, or Firm* — Cantor Colburn LLP

(57) ABSTRACT

A downhole system includes a lower completion having at least one tubular including a first end and a second end terminating at a shoe. The at least one tubular defining a flow path. A packer is arranged at the first end. A fluid loss control valve (FLCV) is arranged between the packer and the shoe. A screen system is arranged between the FLCV and the shoe. The screen system includes a screen and a non-mechanically operated flow control valve that selectively isolates the flow path from formation fluids passing through the screen. A wellbore clean out string is insertable into the lower completion. The wellbore clean out string includes a selectively activated casing cleaner and a setting tool. The selectively activated casing cleaner is spaced from the setting tool.

10 Claims, 9 Drawing Sheets

(56) References Cited

U.S. PATENT DOCUMENTS

| | | | | |
|---|---|---|---|---|
| 2016/0312582 | A1 | 10/2016 | Ali et al. | |
| 2018/0073335 | A1 | 3/2018 | Patel | |
| 2018/0283135 | A1* | 10/2018 | Smith | E21B 21/003 |
| 2019/0203563 | A1* | 7/2019 | Gano | E21B 33/12 |
| 2019/0226301 | A1* | 7/2019 | Rahman | E21B 37/00 |

* cited by examiner

SYSTEM FOR SETTING A LOWER COMPLETION AND CLEANING A CASING ABOVE THE LOWER COMPLETION

BACKGROUND

In the resource recovery industry, after drilling a first portion of a wellbore, a casing tubular is installed and cemented into place. The casing tubular supports an annular wall of the first portion of the wellbore. After installation of the casing tubular, the wellbore may be drilled to a deeper depth across a target resource bearing zone. Once the wellbore is at depth, a workstring may be run in to install a lower completion. The lower completion includes a packer that seals against the casing and screen systems that mitigate sand production. In some cases, the packers may separate the lower completion into distinct production zones.

The lower completion is typically first run in to a selected installation depth. Once at the selected installation depth, the packer is set to secure the lower completion in place. Circulations can be made before or after setting the packer to condition an open hole section of the wellbore for subsequent production. A fluid loss control valve (FLCV) or a formation isolation valve can be located in the upper section of the lower completion and closed with retrieval of setting tools. The FLCV prevents losses to the reservoir and contamination of the lower completion with debris.

In a second trip wellbore clean out tools are run into the wellbore to an upper portion of the lower completion. These wellbore clean out tools may include casing brushes, casing scrapers, magnets, filters, jetting tools and the like. The casing brushes and casing scrapers are usually in contact with the casing on the trip in the hole. This contact between the casing brushes and/or casing scrapers with the casing on the trip in may lead to a scraping and accumulation of debris below the tools. Once the clean out tools are located just above the lower completion, fluid is circulated down the workstring to remove any sediment and cleanings that may accumulate via the return flow path up an annulus defined between the workstring and sides of the wellbore. The clean out tools are not run in combination with the lower completion to assure that any debris accumulating below the tools does not lead to failure of setting the lower completion packer or releasing the setting tool.

Lower completions can be set deep in the wellbore. Running wellbore cleaning tools to the top of the lower completion takes time and resources. Further, the need for a dedicated cleaning trip, while effective for mitigating risk of debris build up, increases completion installation time. Reducing installation time and, the time required to bring a wellbore to production will lower costs. Accordingly, the industry would welcome a system that could eliminate the need for a dedicated, separate, cleaning trip after setting a lower completion.

SUMMARY

Disclosed is a downhole system including a lower completion having at least one tubular including a first end and a second end terminating at a shoe. The at least one tubular defining a flow path. A packer is arranged at the first end. A fluid loss control valve (FLCV) is arranged between the packer and the shoe. A screen system is arranged between the FLCV and the shoe. The screen system includes a screen and a non-mechanically operated flow control valve that selectively isolates the flow path from formation fluids passing through the screen. A wellbore clean out string is insertable into the lower completion. The wellbore clean out string includes a selectively activated casing cleaner and a setting tool. The selectively activated casing cleaner is spaced from the setting tool.

Also disclosed is a resource exploration and recovery system including a surface system, a subsurface system including a wellbore casing and a downhole system extending through the wellbore casing. The downhole system including a lower completion having at least one tubular including a first end and a second end terminating at a shoe. The at least one tubular defining a flow path. A packer is arranged at the first end. A fluid loss control valve (FLCV) is arranged between the packer and the shoe. A screen system is arranged between the FLCV and the shoe. The screen system includes a screen and a non-mechanically operated flow control valve that selectively isolates the flow path from formation fluids passing through the screen. A wellbore clean out string is insertable into the lower completion. The wellbore clean out string includes a selectively activated casing cleaner and a setting tool. The selectively activated casing cleaner is spaced from the setting tool.

Further disclosed is a method of setting a lower completion and cleaning a wellbore including a cased portion and an open hole portion in a single trip, the method including running the lower completion into a wellbore to a selected setting depth on a wellbore setting and clean out string, circulating fluids through a flow bore of the lower completion out through a terminal end to remove debris and condition the open hole portion, preventing fluid from passing through screens on the lower completion with a non-mechanically operated valve, setting a packer on the lower completion, releasing the wellbore setting and clean out string from the lower completion, activating a casing cleaner on the wellbore setting and clean out string, moving the wellbore setting and clean out string to clean the cased portion, circulating fluids though the terminal end of the wellbore setting and clean out string to remove debris, and closing a fluid loss control valve (FLCV) to isolate the lower completion from debris and prevent losses to formation.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
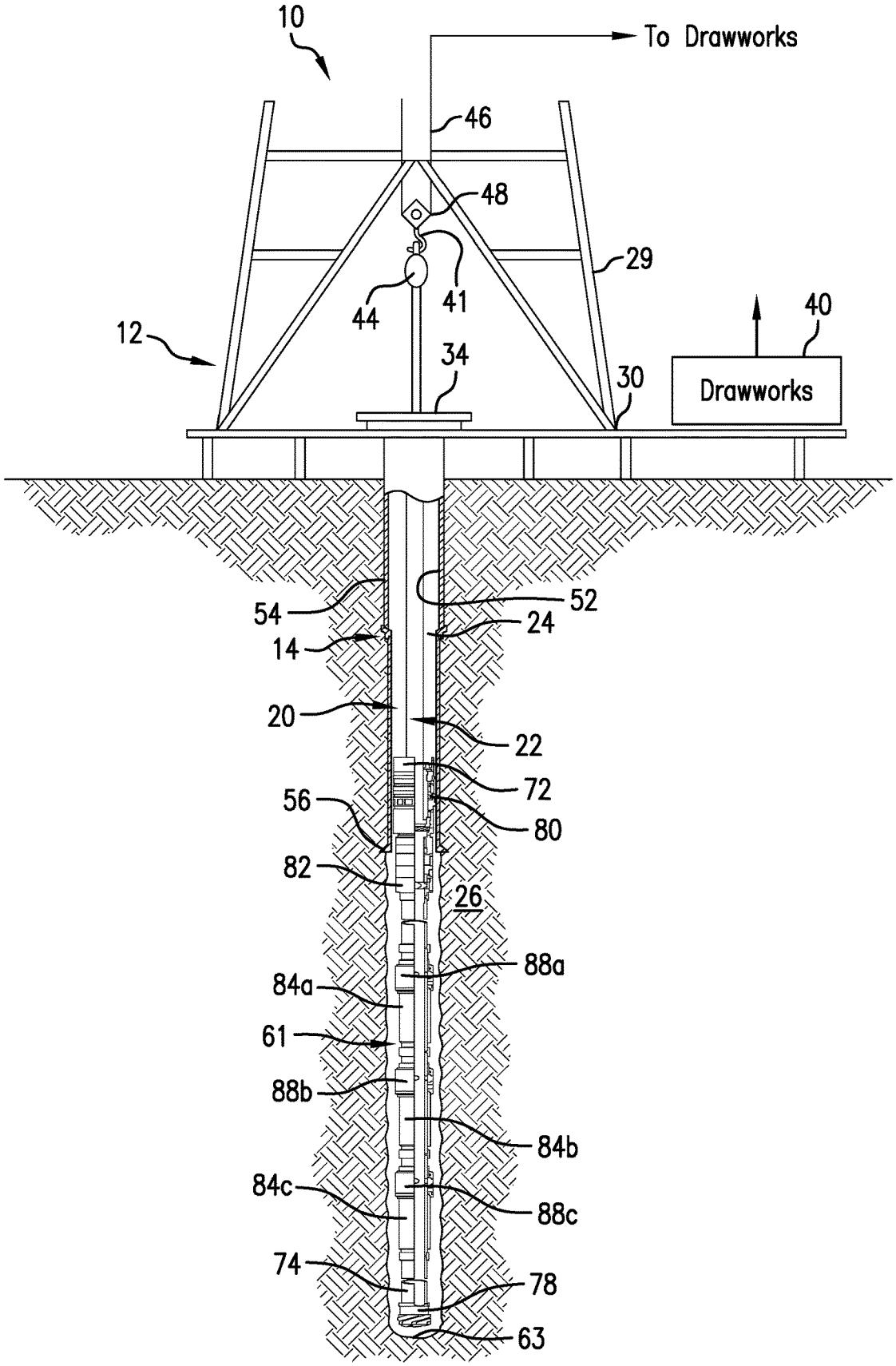
FIG. 1 depicts a resource exploration and recovery system including a system for setting a lower completion and cleaning a casing above the lower completion in a single downhole trip, in accordance with an aspect of an exemplary embodiment.

FIG. 1 shows a schematic diagram of a resource exploration and recovery system 10 for performing downhole operations. As shown, resource exploration and recovery system 10 includes a surface system 12 and a subsurface system 14 including a wellbore setting and clean out string 20 formed from a plurality of tubular members 22 conveyed in a wellbore 24 penetrating an earth formation 26. Surface system 12 includes a conventional derrick 29 erected on a floor 30 that supports a rotary table 34 that is rotated by a prime mover, such as an electric motor (not shown), at a desired rotational speed.

Wellbore setting and clean out string 20 extends downward from the rotary table 34 into the wellbore 24. Tubular string 20 may be coupled to surface equipment such as systems for lifting, rotating, and/or pushing, including, but not limited to, a drawworks 40 via a kelly joint 41, swivel 44 and line 46 through a pulley 48. In some embodiments, the surface equipment may include a top drive (not shown). Wellbore 24 includes an annular wall 52 that may be defined, in part, by a casing tubular 54 that extends from adjacent floor 30 to a casing shoe 56. Below casing shoe 56, wellbore 24 takes on an open hole configuration.

In an exemplary embodiment, a lower completion 61 extends from just above casing shoe 56 toward a toe 63 of wellbore 24. Lower completion 61 is tripped in hole and set in position at a selected depth by wellbore setting and clean out string 20. That is, as will be detailed herein, wellbore setting and clean out string 20 positions and sets lower completion 61 and cleans internal surfaces of casing tubular 54 in a single downhole trip.

Figure 2A:
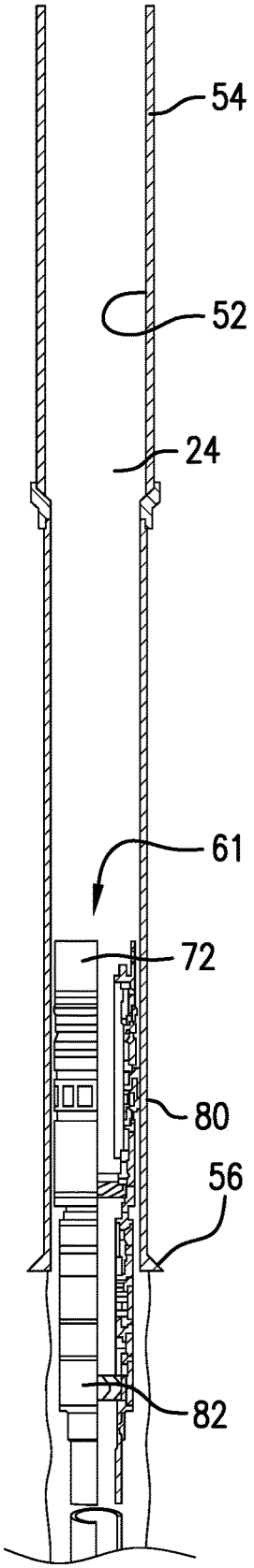
FIG. 2A depicts a first portion of the lower completion of FIG. 1, in accordance with an aspect of an exemplary embodiment.
Figure 2B:
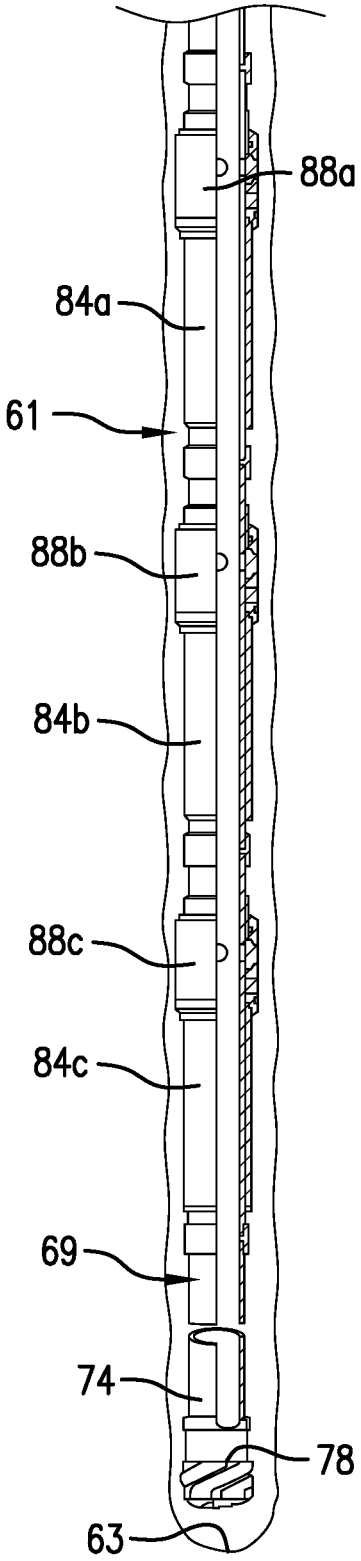
FIG. 2B depicts a second portion of the lower completion of FIG. 1 including a screen system and a non-mechanically operated flow control valve, in accordance with an aspect of an exemplary embodiment.

Referring to FIGS. 2A and 2B, lower completion 61 is formed from one or more tubulars 69 that define a flow path 70 (FIG. 7) having a first end 72 and a second end 74 that terminates in a shoe 78 positioned at toe 63. A sand control packer 80 is positioned adjacent to first end 72 and engages with casing tubular 54 uphole of casing shoe 56. A fluid loss control valve (FLCV) which may take the form of a formation isolation valve (FIV) 82 is disposed downhole of sand control packer 80. A plurality of screen systems indicated at 84*a*, 84*b*, and 84*c* are disposed downhole of FLCV 82. The number and arrangement of screen systems may vary. Also, it should be understood that screen systems 84*a*-84*c* may be divided into a number of separate production zones.

Screen systems 84*a*-84*c* provide a pathway for formation fluids passing from formation 26 to flow uphole to surface system 12. As will be detailed herein, each screen system 84*a*-84*c* includes a non-mechanically operated flow control valve such as indicated at 88*a*, 88*b*, and 88*c* that selectively allow formation fluids to pass into flow path 70. At this point, it should be understood that the term "non-mechanically operated" describes a valve that is operated, e.g., opened and/or closed without the use of a mechanical member such as a shifting tool, a setting tool, a tractor or the like. The non-mechanically operated flow control valves 88 force fluid to exit the shoe 78 of the lower completion 61 instead of exiting through the screens 84*a, b, c* and thereby eliminate the need to run a concentric inner washpipe string.

Figure 3:
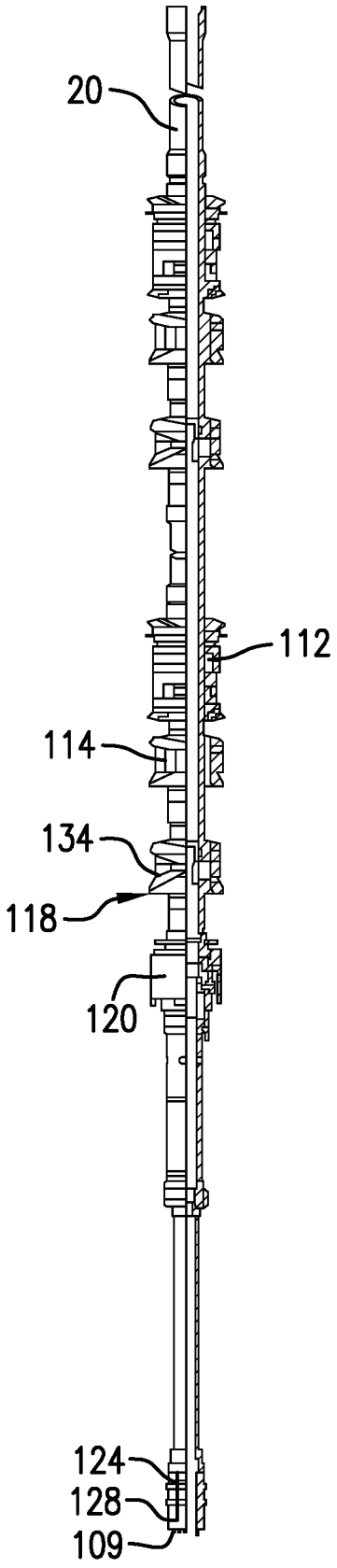
FIG. 3 depicts a wellbore setting and clean out string, in accordance with an aspect of an exemplary embodiment.

As noted above, lower completion 61 is run into wellbore 24 and positioned at a selected depth on wellbore setting and clean out string 20. Referring to FIG. 3, wellbore setting and clean out string 20 extends from rotary table 34 to a terminal end 109. Wellbore setting and clean out string 20 may include a wellbore filter 112, a magnet 114 that captures debris that may be removed from casing tubular 54, and a selectively expandable scraper 118. Wellbore setting and clean out string 65 may also include a setting tool 120 that activates sand control packer 80 and a shifting tool 124 that may be used to activate/shift FIV 82 between and open and a closed configuration. A jet cleaning tool 128 may be provided downhole of shifting tool 124.

In an embodiment, selectively expandable scraper 118 may include a ball seat 134 receptive of a drop ball (not shown) that releases scraper elements (also not shown). At this point, it should be understood that while described as including a ball seat, selectively expandable scraper 118 may be activated through use of any number of other systems including, but not limited to, applied pressure, pressure pulses, radio frequency identification (RFID), a timer, acoustic systems, as well as applied force such as compression, tension, and torque. Regardless of the system employed, selectively expandable scraper 118 is deployed after lower completion 61 is at the selected depth so as to avoid debris accumulating on completion components.

Figure 4:
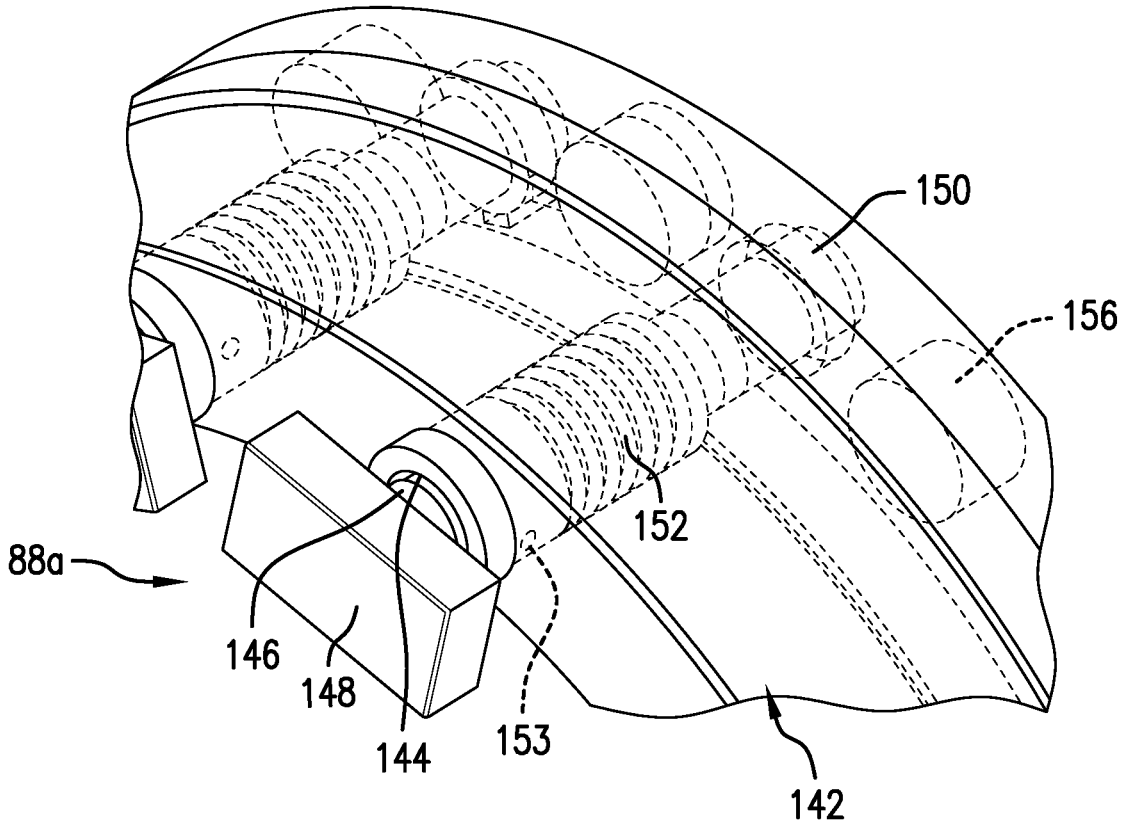
FIG. 4 depicts the non-mechanically operated flow control valve disposed in the lower completion of FIG. 2B shown in a closed configuration, in accordance with an aspect of an exemplary embodiment.
Figure 5:
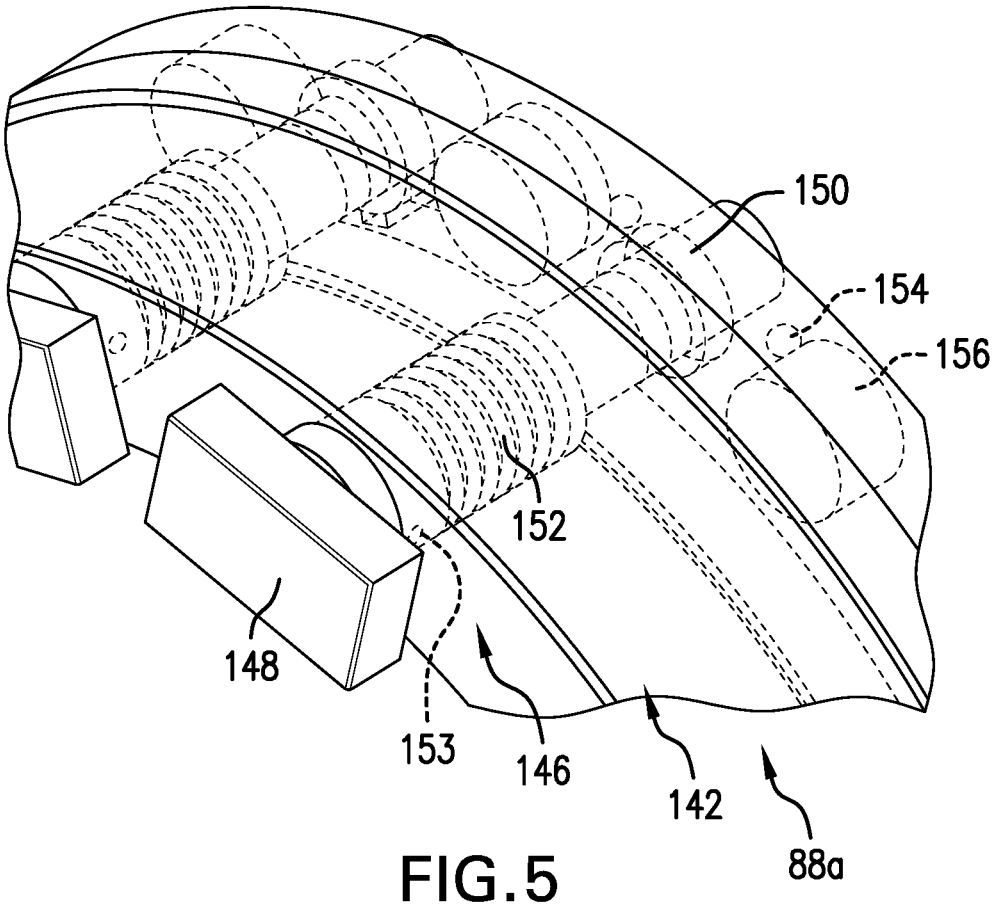
FIG. 5 depicts the non-mechanically operated flow control valve of FIG. 4 in a pre-opening configuration, in accordance with an aspect of an exemplary embodiment.
Figure 6:
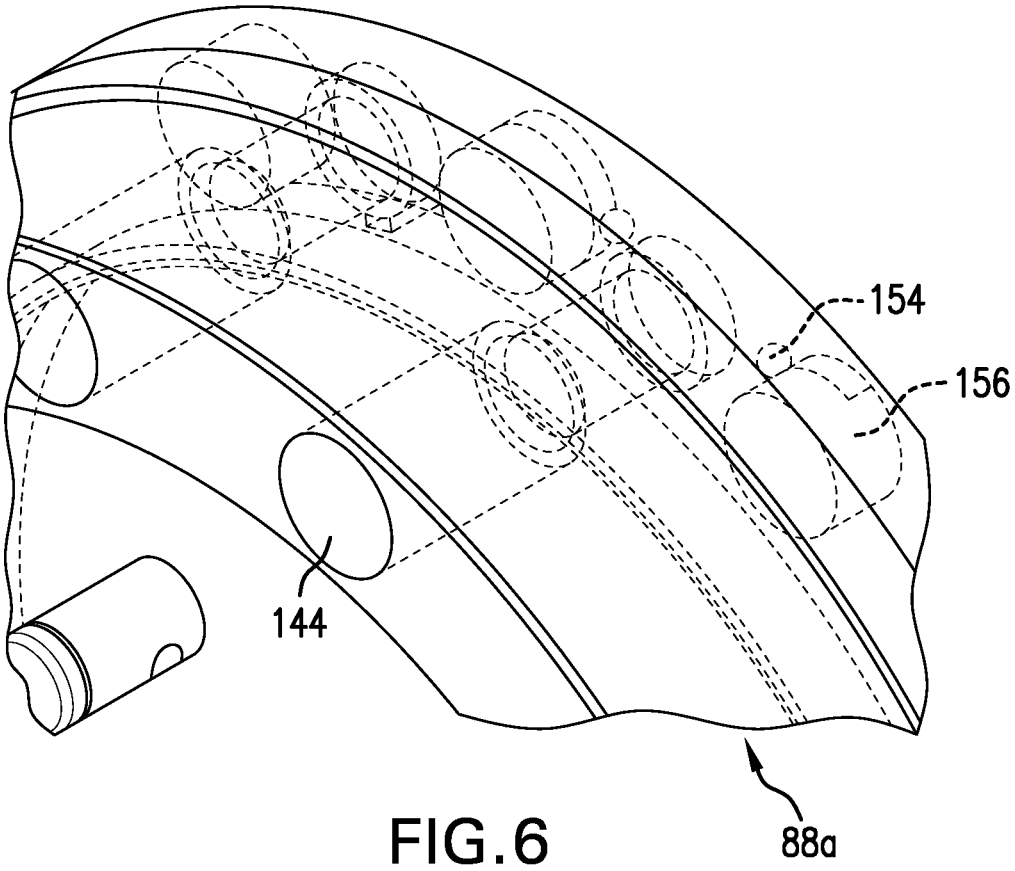
FIG. 6 depicts the non-mechanically operated flow control valve of FIG. 4 in an open configuration, in accordance with an aspect of an exemplary embodiment.

Reference will now follow to FIGS. 4-6 in describing non-mechanically operated flow control valve 88*a* in accordance with an exemplary aspect. Non-mechanically operated flow control valve 88*a* includes a body 142 through which pass a plurality of selectively openable flow ports 144. A selectively releasable piston 146 is disposed in each of the selectively openable flow ports 144. Each selectively releasable piston 146 includes a head end 148 and a tail end 150. A spring 152 extends about tail end 150 and, when selectively releasable piston 146 is installed in flow port 144, is compressed. Tail end 150 may include a guide element (not shown) and flow port 144 may include a guide track also not shown) that interact to impose a rotational force to selectively releasable piston 146. A shear wire or other shear device 153 may be present at the head end 148 to restrict the movement of selectively releasable piston 146 in response to increased pressure acting on head. Retainer balls 154 may be employed to prevent the ejection of the piston 146 due to increased pressure acting on head end 148.

Figure 7:
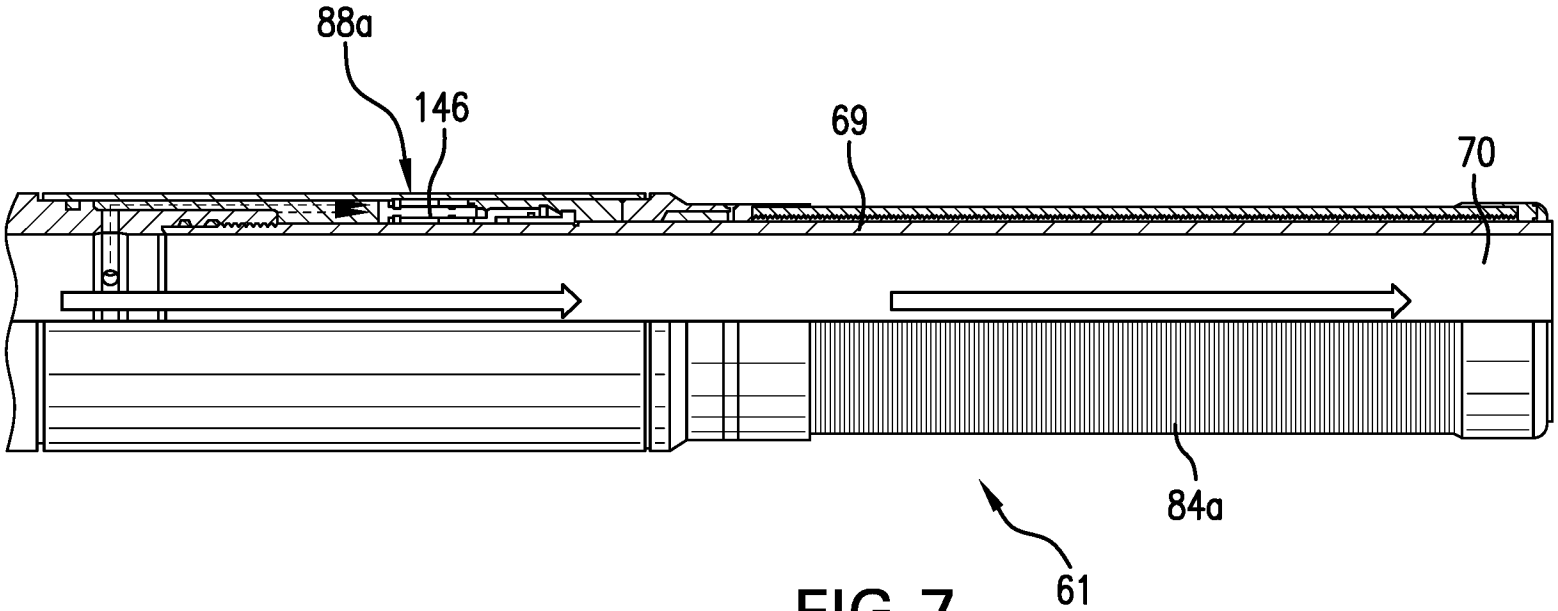
FIG. 7 depicts the screen system of FIG. 2B in a fluid circulating configuration, in accordance with an exemplary embodiment.

In operation, non-mechanically operated flow control valve 88*a* is run into wellbore 24 on lower completion 61 in a closed configuration such as shown in FIGS. 4 and 7. Pressure may be applied to head end 148 causing selectively releasable piston 146 to travel axially through flow port 144 as shown in FIG. 5. The axial travel results in breaking of shear device 153 and the release of the retainer balls 154. Retainer balls 154 are captured by magnets 156 contained within body 142.

Figure 8:
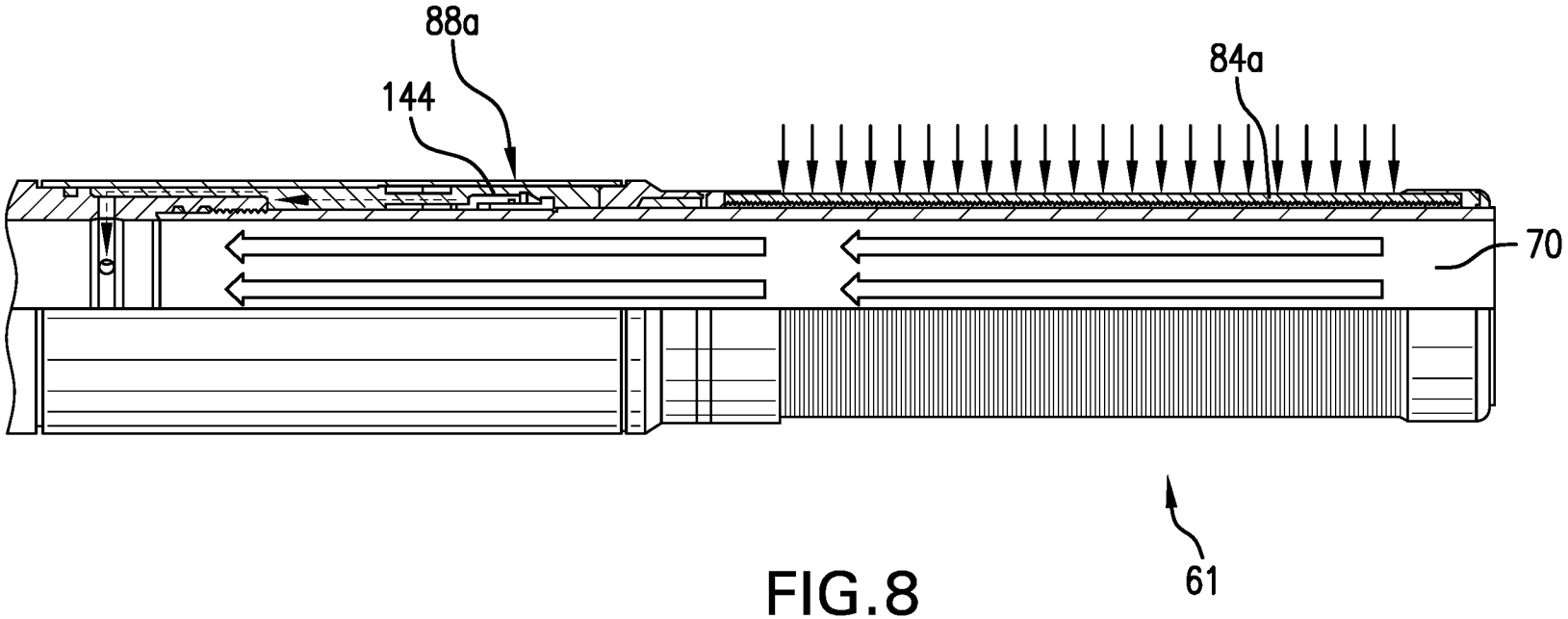
FIG. 8 depicts the screen system of FIG. 7 in a production configuration, in accordance with an exemplary embodiment.

In this manner, releasing the pressure allows spring 152 to eject selectively releasable piston 146 from flow port 144 as shown in FIG. 8. Once ejected, formation fluids may pass through screen system 84*a* and enter flow path 70. At this point it should be understood that while described as being operated by pressure, non-mechanically operated flow control valve 88*a* may be activated through other systems including, but not limited to, pressure pulses, radio frequency identification (RFID), a timer, acoustic systems, as well as applied force such as compression, tension, and torque.

In operation, wellbore setting and clean out string 20 may run lower completion 61 into wellbore 24 to a depth that is lower than the selected setting depth. A drop ball may be introduced into wellbore setting and clean out string 20 to deploy selectively deployable scraper 118. In an embodiment, ball seat 134 may be yieldable such that the drop ball may be pumped further down wellbore setting and clean out string 20.

Wellbore setting and clean out string 20 may then pick up lower completion 61 to setting depth with selectively deployable scraper 118 cleaning surfaces of casing tubular 54. Fluid may circulate downhole to ensure that debris does not build up on sand control packer 80 or other completion systems. With non-mechanically operated flow control valve 88*a* in a closed configuration as shown in FIG. 7, fluid may circulate through flow path 70 and out through shoe 78. Another drop ball may be introduced into wellbore setting and clean out string 20 and pumped down to setting tool 120 to set sand control packer 80 and lock lower completion 61 to casing tubular 54 at the selected depth.

After deploying sand control packer 80, pressure may be applied to non-mechanically operated flow control valve 88*a* causing pistons 146 to be ejected openings flow ports 144. At this point, wellbore setting and clean out string 20 may be released from lower completion 61 and picked up a short distance to close FLCV 82. The short pickup length to close FIV 82 is enabled by the use of non-mechanically operated fluid control valves 88*a*, 88*b*, and 88*c*. Once FIV 82 is closed there is no risk of losses to formation or contamination of the lower completion with debris from clean out operations. Formation fluid may pass through each screen system 84*a*, 84*b*, and 84*c* such as shown in FIG. 8. Further, additional fluid may be circulated above FIV 82 to wash and wellbore setting and clean out string 20 may be withdrawn from wellbore 24. In this manner, lower completion 61 may be run in, and casing tubular 54 cleaned, in a single trip into wellbore 24. By setting the lower completion and cleaning the casing, exemplary embodiments allow operators to increase operational efficiencies, reduce time needed to start production and significantly reduce costs to form the wellbore.

Set forth below are some embodiments of the foregoing disclosure:

Embodiment 1

A downhole system comprising: a lower completion including at least one tubular having a first end and a second end terminating at a shoe, the at least one tubular defining a flow path; a packer arranged at the first end; a fluid loss control valve (FLCV) arranged between the packer and the shoe; a screen system arranged between the FLCV and the shoe, the screen system including a screen and a non-mechanically operated flow control valve that selectively isolates the flow path from formation fluids passing through the screen; and a wellbore clean out string insertable into the lower completion, the wellbore clean out string including a selectively activated casing cleaner and a setting tool, the selectively activated casing cleaner being spaced from the setting tool.

Embodiment 2

The downhole system according to any prior embodiment, wherein the non-mechanically operated flow control valve includes one or more flow ports.

Embodiment 3

The downhole system according to any prior embodiment, wherein each of the one or more flow ports includes a selectively releasable piston.

Embodiment 4

The downhole system according to any prior embodiment, wherein the selectively activated casing cleaner includes a ball seat.

Embodiment 5

The downhole system according to any prior embodiment, wherein the ball seat is selectively yieldable.

Embodiment 6

The downhole system according to any prior embodiment, wherein the wellbore clean out string includes one of a magnet and a filter sub.

Embodiment 7

The downhole system according to any prior embodiment, further comprising: a jet cleaning tool mounted to the wellbore clean out string adjacent the setting tool.

Embodiment 8

The downhole system according to any prior embodiment, wherein the FLCV is a formation isolation valve (FIV).

Embodiment 9

The downhole system according to any prior embodiment, wherein the selectively activated casing cleaner includes one of a casing scraper, a casing brush, and a jetting sub.

Embodiment 10

A resource exploration and recovery system comprising: a surface system; a subsurface system including a wellbore casing and a downhole system extending through the wellbore casing, the downhole system comprising: a lower completion including at least one tubular having a first end and a second end terminating at a shoe, the at least one tubular defining a flow path; a packer arranged at the first end; a fluid loss control valve (FLCV) arranged between the packer and the shoe; a screen system arranged between the FLCV and the shoe, the screen system including a screen and a non-mechanically operated flow control valve that selectively isolates the flow path from formation fluids passing through the screen; and a wellbore clean out string insertable into the lower completion, the wellbore clean out string including a selectively activated casing cleaner and a setting tool, the selectively activated casing cleaner being spaced from the setting tool spaced from the setting tool.

Embodiment 11

The downhole system according to any prior embodiment, wherein the non-mechanically operated flow control valve includes one or more flow ports.

Embodiment 12

The downhole system according to any prior embodiment, wherein each of the one or more flow ports includes a selectively releasable piston.

Embodiment 13

The downhole system according to any prior embodiment, wherein, the selectively activated casing cleaner includes a ball seat.

Embodiment 14

The downhole system according to any prior embodiment, wherein the ball seat is selectively yieldable.

Embodiment 15

The downhole system according to any prior embodiment, wherein the wellbore clean out string includes one of a magnet and a filter sub.

Embodiment 16

The downhole system according to any prior embodiment, further comprising: a jet cleaning tool mounted to the wellbore clean out string adjacent the setting tool.

Embodiment 17

The downhole system according to any prior embodiment, wherein the selectively activated casing cleaner includes one of a casing scraper, a casing brush, and a jetting sub.

Embodiment 18

A method of setting a lower completion and cleaning a wellbore including a cased portion and an open hole portion in a single trip, the method comprising: running the lower completion into a wellbore to a selected setting depth on a wellbore setting and clean out string; circulating fluids through a flow bore of the lower completion out through a terminal end to remove debris and condition the open hole portion; preventing fluid from passing through screens on the lower completion with a non-mechanically operated valve setting a packer on the lower completion; releasing the wellbore setting and clean out string from the lower completion; activating a casing cleaner on the wellbore setting and clean out string; moving the wellbore setting and clean out string to clean the cased portion; circulating fluids though the terminal end of the wellbore setting and clean out string to remove debris; and closing a fluid loss control valve (FLCV) to isolate the lower completion from debris and prevent losses to formation.

Embodiment 19

The method according to any prior embodiment, wherein activating the casing cleaner includes dropping a ball into the wellbore setting and clean out string.

Embodiment 20

The method according to any prior embodiment, wherein activating of the casing cleaner occurs prior to setting the packer when the lower completion is spaced from the selected setting depth.

Embodiment 21

The method according to any prior embodiment, where in the casing cleaner is one of a casing scraper, a casing brush, and a jetting sub.

Embodiment 22

The method according to any prior embodiment, wherein the FLCV is closed immediately following starting cleanup operations to prevent losses and prevent debris from contaminating the lower completion.

Embodiment 23

The method according to any prior embodiment, wherein circulation fluids through the terminal end is initiated after closing the FLCV.

Embodiment 24

The method according to any prior embodiment, wherein the casing cleaner is activated prior to setting the packer to clean portions of the cased portion at the selected setting depth.

Embodiment 25

The method according to any prior embodiment, wherein the FLCV comprises a formation isolation valve (FIV) that resists pressure in both directions.

Embodiment 26

The method according to any prior embodiment, wherein the wellbore setting and clean out string contains at least one of a brush, a magnets, a filter subs, and a jetting tool to clean the wellbore above the lower completion.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of setting a lower completion and cleaning a wellbore including a cased portion and an open hole portion in a single trip, the method comprising:

running the lower completion into the open hole portion of the wellbore to a selected setting depth on a wellbore setting and clean out string;

circulating fluids through a flow bore of the lower completion out through a terminal end to remove debris and condition the open hole portion;

preventing fluid from passing through screens on the lower completion with a non-mechanically operated valve;

setting a packer on the lower completion while connected with wellbore setting and clean out string;

releasing the wellbore setting and clean out string from the lower completion;

activating a casing cleaner on the wellbore setting and clean out string;

moving the wellbore setting and clean out string to clean the cased portion;

circulating fluids though the terminal end of the wellbore setting and clean out string to remove debris; and closing a fluid loss control valve (FLCV) to isolate the lower completion from debris and prevent losses to formation.

2. The method of claim 1, wherein activating the casing cleaner includes dropping a ball into the wellbore setting and clean out string.

3. The method of claim 1, wherein activating of the casing cleaner occurs prior to setting the packer when the lower completion is spaced from the selected setting depth.

4. The method of claim 1, where in the casing cleaner is one of a casing scraper, a casing brush, and a jetting sub.

5. The method of claim 1, wherein the FLCV is closed immediately following starting cleanup operations to prevent losses and prevent debris from contaminating the lower completion.

6. The method of claim 1, wherein circulation fluids through the terminal end is initiated after closing the FLCV.

7. The method of claim 1, wherein the casing cleaner is activated prior to setting the packer to clean portions of the cased portion at the selected setting depth.

8. The method of claim 1, wherein the FLCV comprises a formation isolation valve (FIV) that resists pressure in both directions.

9. The method of claim 1, wherein the wellbore setting and clean out string contains at least one of a brush, a magnets, a filter subs, and a jetting tool to clean the wellbore above the lower completion.

10. A method of setting a lower completion and cleaning a wellbore including a cased portion and an open hole portion in a single trip, the method comprising:

running the lower completion into the wellbore to a selected setting depth on a wellbore setting and clean out string;

circulating fluids through a flow bore of the lower completion out through a terminal end to remove debris and condition the open hole portion;

preventing fluid from passing through screens on the lower completion with a non-mechanically operated valve;

setting a packer on the lower completion;

releasing the wellbore setting and clean out string from the lower completion;

activating a casing cleaner on the wellbore setting and clean out string prior to setting the packer when the lower completion is spaced from the selected setting depth;

moving the wellbore setting and clean out string to clean the cased portion;

circulating fluids though the terminal end of the wellbore setting and clean out string to remove debris; and closing a fluid loss control valve (FLCV) to isolate the lower completion from debris and prevent losses to formation.

* * * * *